US006322334B1

(12) United States Patent
Klipstein

(10) Patent No.: US 6,322,334 B1
(45) Date of Patent: Nov. 27, 2001

(54) ROTARY PISTON SYSTEM

(76) Inventor: Thomas Klipstein, Wietrele 30, D-22359 Hamburg (DE)

( * ) Notice: Subject to any disclaimer, the term of this patent is extended or adjusted under 35 U.S.C. 154(b) by 0 days.

(21) Appl. No.: 09/242,332

(22) PCT Filed: Aug. 13, 1997

(86) PCT No.: PCT/EP97/04388

§ 371 Date: Feb. 11, 1999

§ 102(e) Date: Feb. 11, 1999

(87) PCT Pub. No.: WO98/07964

PCT Pub. Date: Feb. 26, 1998

(30) Foreign Application Priority Data

Aug. 16, 1996 (DE) ..... 296 14 108 U

(51) Int. Cl.[7] ..... F04B 35/04; F03C 2/00
(52) U.S. Cl. ..... 417/410.3; 418/150
(58) Field of Search ..... 417/410.3; 418/150

(56) References Cited

U.S. PATENT DOCUMENTS 3,624,740 * 11/1971 Hogguer ..... 123/8.07
5,439,357 * 8/1995 Barthold et al. ..... 417/410.3

FOREIGN PATENT DOCUMENTS

| | | |
|---|---|---|
| 588285 | 11/1933 | (DE) . |
| 0408992A2 | 1/1991 | (EP) . |
| 874045 | 8/1961 | (GB) . |
| WO 94/13934 | 6/1994 | (WO) . |

* cited by examiner

*Primary Examiner*—Charles G. Freay
(74) *Attorney, Agent, or Firm*—Venable; John P. Shannon; Eric J. Weierstall

(57) ABSTRACT

The present invention relates to a rotary piston system mounted within an engine or a pump and characterized in that a piston moves inside a housing, thus reducing or enlarging closed spaces. The piston is an oloid element rotating about its axis. The internal space consists of two identical shells contiguously assembled along the equatorial planes thereof. The space defined by the shells inside the housing has an enveloping surface resulting from the biaxial rotation of the oloid element, the maximum diameter of which corresponds to its longitudinal profile.

15 Claims, 8 Drawing Sheets

FIG. 1C FIG. 1B
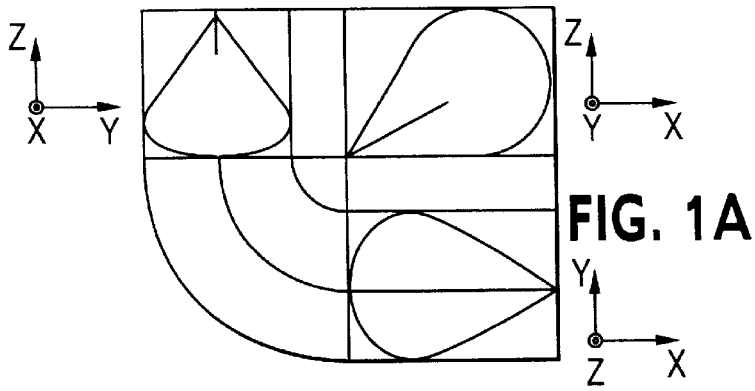
FIG. 1A
FIG. 2
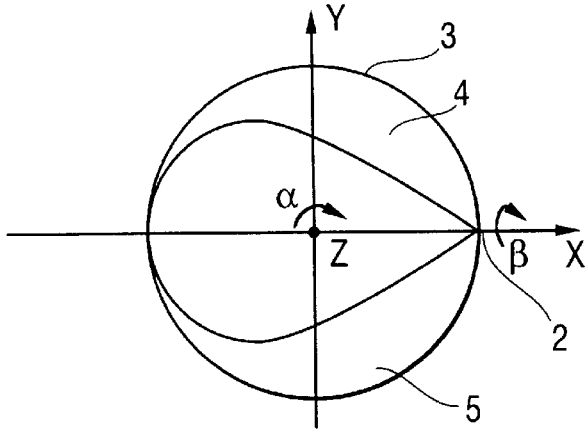
FIG. 3
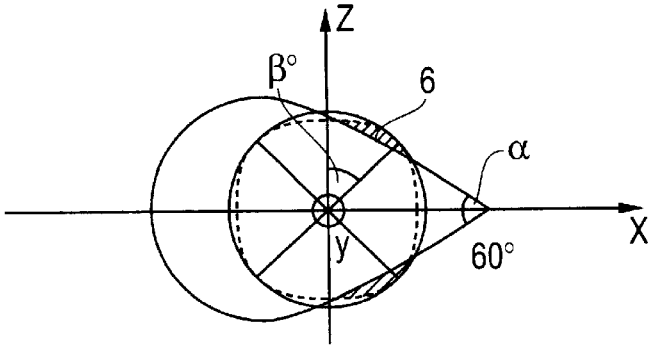

ROTARY PISTON SYSTEM

BACKGROUND OF THE INVENTION

This invention relates to a rotary piston system, engine, or pump having a piston which moves inside a housing and in doing so enlarges and reduces an enclosed space. (*Meyers Grosses Taschenlexikon*, 5th Edition, 1995, Volume 19, page 7). A rolling piston engine with a discus-shaped plunger disk is disclosed in DE 588 285 C.

In this invention the term "rotation" is understood to mean that reciprocating oscillating movements are possible, i.e., that no complete rotations are performed in succession, but, for example, oscillating movements as well.

The rotary piston system described in what follows differs from state-of-the-art designs in its use of fewer parts (piston and rotary cylinder) and in its rotation about its center of mass (with no eccentricity). This results in high efficiency and permits simple and accordingly cost-effective designs. As is the case with other piston engines, it does so without valves.

Generally speaking, piston engines are based on the principle that a piston that is movable relative to a jacket increases or reduces an enclosed volume. The piston is assigned the function of restricting this volume as closely as possible. It can be shown that simple rotation of a piston about an axis results in rotation-symmetrical configurations and causes no changes in volume in any chambers present. An innovative step is represented by the Wankel engine, in which gearing causes oscillation of the piston in a special enveloping form to bring about change in volume in the chambers. The piston of the Wankel engine does not, however, rotate about the center of mass.

SUMMARY OF THE INVENTION

In one embodiment of the present invention, it is possible for a change in volume to occur during simultaneous rotation about the center of mass of the piston. Specifically, through simultaneous rotation of the piston of the invention about two axes, non-symmetrical rotational configurations are achieved, which are a prerequisite for the formation of varying piston chamber volumes. It is also possible for a change in volume to occur during simultaneous rotation of the piston about two axes through appropriate selection of the shape of the rotary piston and of the enveloping shape of the housing ("cylinder"), and by finding a suitable function which links the rotation of the two axes.

The initial shape of a preferred embodiment of the rotary piston claimed for the invention is the oloid discovered by Paul Schatz (CH 500 000 C5). The oloid is a body which is formed by developable ruled surfaces. Its formation may be compared to intersection of two beer mug coasters at the midpoint of each and intersecting at 90° to one another so that the coasters form a cross. The circumference of one coaster passes through the center of the other coaster. If this configuration is placed on a level surface, such as a table, each of the two coasters touches the surface at one point. This applies to any possible position of the two coasters. The connecting line between the bearing points is the envelope line of the oloid (see FIG. 1).

In addition to its aesthetic aspect, the oloid has certain symmetrical properties which are of interest in the context of the invention. If the oloid is rotated 90° about its horizontal axis, it assumes a position which corresponds to being rotated 180° about the vertical axis.

If the oloid is rotated simultaneously about the horizontal axis (90°) and the vertical axis (180°), it returns to its initial position (See FIGS. 1, 2, 10, 14). If the shape of the envelope defined by this movement is observed, a configuration which is not rotationally symmetrical is seen to emerge, one which is divided into approximately two chambers by the oloid. These two chambers migrate during rotation with the oloid about the vertical axis and are of the same size only in the "normal position". One chamber is compressed as the other expands. The maximum is situated at 90° about the vertical axis and 45° about the horizontal axis. Two cycles of compression and expansion take place during each complete rotation about the vertical axis of the oloid.

The shape enveloping the oloid must be selected so that the two rotating chambers are separated by the piston. In addition, the rotation of the oloid about the horizontal axis is to be imposed on the oloid by the envelope. For this purpose, one should again visualize the shape of the envelope which arises when the oloid is rotated 180° about the vertical axis and at the same time 90° about the horizontal axis. A change in the direction of rotation about the horizontal axis results in an envelope of a different shape. If the situation is analyzed more thoroughly, it is found that, if the direction of rotation about the horizontal axis is continued, the "first" 180-degree rotation about the vertical axis describes an envelope shape different from that described by the "second" rotation. Thus, imposition of movement of the oloid about the horizontal axis is not possible in this way. That is, there is no complete rotation about the horizontal axis; the oloid rather oscillates between 0° and 90° about the horizontal axis (see FIGS. 2 and 3).

If the requirement is made that the envelope is always to be divided into two chambers by the oloid, the section through the oloid and the envelope must be identical at least in the normal position. If the oloid is rotated in its envelope, this section should not change. Such is not the case, however. Note the shaded areas of FIG. 3. The shape of the envelope depends on the shape of the oloid and a function $\beta$ (FIG. 4). In the process of the invention, parts of the envelope are generated by the circular edges of the oloid and parts by the jacket lines. Problem zones arise in this case around the vertical axis and the pointed end of the section (shaded areas FIG. 3). The problem zones in the area of the vertical axis can be reduced or eliminated by extending the generating circles of the oloid (aperture angle 45°) and, in addition, by creating a sphere around the center which encloses the problem areas. (FIG. 3).

The sphere and its shell, as part of the envelope, ensure separation of the two chambers in the area around the vertical axis. The area at the pointed end of the section still remains. If separation of the chambers in the vicinity around the base position is to take place here, the envelope generated by the circular edges must be identical in a small area to the envelope parts generated by the jacket lines. It can be demonstrated for the other part of the jacket that hermetic separation exists between the chambers.

Unlike the situation in conventional engines, mechanical coupling to the rotary movement of the rotary piston cannot be accomplished by simple means. When the engine as described is used as a suction pump, for example, the option is available of designing the rotary piston as the armature (60) of an electric motor, as shown in FIG. 9, and of providing the envelope with a suitable winding (12). An expansion chamber 50 and a compression chamber 55 are defined by the piston armature 60, as shown in FIG. 5. An intake 57 and an outlet 55 are located opposite one another perpendicular to the XZ plane, a plane of symmetry through the envelope. There would then be a pump with only one moving part. Aside from frictional losses, no losses arise, ones due to mass deflection, for example, since the energy of oscillation for oscillation about the horizontal axis is taken from the movement about the vertical axis and also delivered back to it. The piston thus executes a pulsating movement.

The piston on which the preferred embodiment of the invention is based is not identical to the form found by Paul Schatz. It does, however, possess the symmetrical properties of the form found by Paul Schatz. Modifications in the form of the piston are to be found in the spacing of the generating circles, the alternative penetration by a sphere in the center, and a (slight) deformation of the oloid jacket. Other modifications are conceivable, such as replacement of the circles of the oloid with ellipses. All these modifications bear no relation to the symmetrical properties.

One particular problem with the rotary piston engine claimed for the invention is found in transmission of mechanical forces to the piston or oloid. This problem is that there is no simple way of transmitting the mechanical forces by extension of an axis.

The invention provides a number of possible solutions to this problem, including:

1. Mechanical coupling of forces. For this purpose, the piston is designed to be in three parts, specifically, in such a way that the penetrating sphere is released from the piston. The piston then consists of the sphere and two equal remaining parts. The sphere may then be provided with an axis vertical relative to the force coupling and with an axis horizontal relative to the (movable) connection between the two piston halves and the sphere.

2. Mechanical force coupling by way of the horizontal axis. For this purpose, the piston is provided with a horizontal axis which projects beyond the envelope. The envelope must be designed to be of two parts (top and bottom halves). A circumferential seal must be formed between the halves, a seal which connects the halves with a circumferential "zipper" and protects them from torsion. Rotation of the piston may be transmitted to a shaft by means of a claw.

3. Electromotive force coupling. For this purpose, the piston is designed as the armature of an electric motor. This can be accomplished by embedding iron or magnetic material. There must be mounted around the envelope a stator whose poles are mounted so that they are situated in the plane of the sphere of the oloid in the relevant position. A rotating dualaxis magnetic field which carries the piston with it is generated by a commutator logic system.

4. Electromotive force coupling with an active armature. In the situation in the paragraph above, the armature field was generated externally or by way of permanent magnets. Magnetic fields may also be generated actively if the armature is designed with an electromagnet, and in particular generators may also be built in this way. For this purpose the penetrating sphere must be designed in the form of two "slip ring halves" in order to be able to transmit the necessary energizing current to the armature. This stator is designed as explained in the paragraph above and shown in the figures.

BRIEF DESCRIPTION OF THE DRAWINGS

The invention is explained in what follows with reference to the examples illustrated by the drawings.

FIGS. 1A–1C are top, side and front views, respectively, of an oloid;

FIG. 2 shows an oloid inside an envelope;

FIG. 3 corresponds to the oloid shape of FIG. 2, but superimposes a sphere in the center of the oloid;

DETAILED DESCRIPTION OF THE PREFERRED EMBODIMENTS

Figure 4:
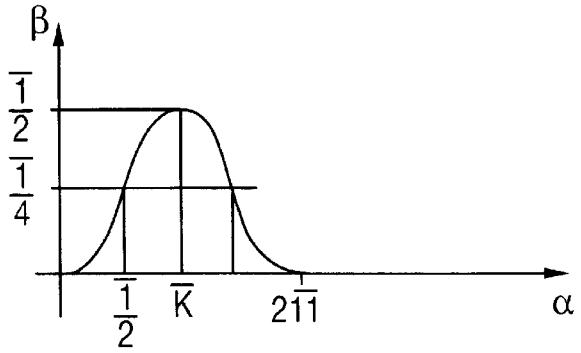
FIG. 4 is a graphic representation of the so-called β function plotted against angle α.

Given below are certain details relating to the construction of a preferred embodiment of a rotary piston engine according to the present invention.

The basis of the is first the special geometry of the piston with regard to its symmetrical properties. As is shown in FIGS. 1A–1C, if a piston in the shape of an oloid, having a first end 1 and a second end 2, is positioned with its horizontal axis on the X axis and its vertical axis on the Y axis, the XY plane (FIG. 1A) and the XZ plane (FIG. 1B) are symmetrical planes, but the YZ plane is not (FIG. 1C). The YZ plane becomes a symmetrical plane if the piston half is rotated 90° about the horizontal axis.

As is seen in FIG. 2, rotation of the oloid piston about the vertical axis through an angle α and rotation about the horizontal axis through an angle β results in the generation of a closed enveloping surface which forms the "cylinder space" or the envelope 3 of the rotary piston engine. Strictly speaking, complete rotation takes place only about the vertical axis, while the piston rotates only 9020 about the horizontal axis. The envelope 3 is divided by the piston into two chambers 4, 5 which rotate about the center with the piston and change their volume in the process.

A compression and vacuum cycle takes place during every 180° rotation about the vertical axis. The ends 1 and 2 change their orientation, swapping positions. The piston looks the same after rotating 180° about the Z-axis and 90° about the X-axis as is shown in FIG. 2, but the positions of the ends 1 and 2 are swapped.

Figure 6:
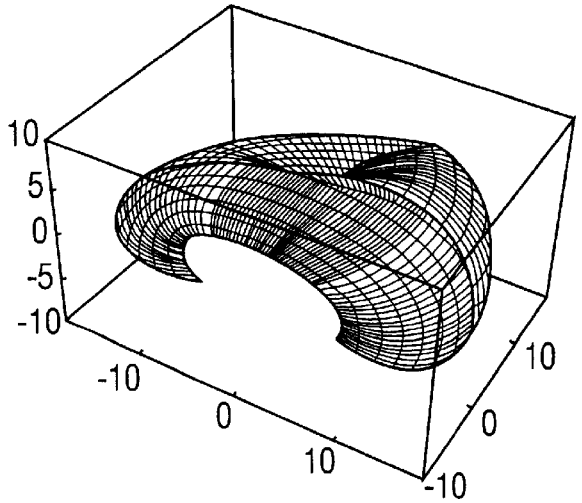
FIG. 6 is a diagrammatic partial view of the envelope of a rotary piston engine for an oloid with a sphere.
Figure 7:
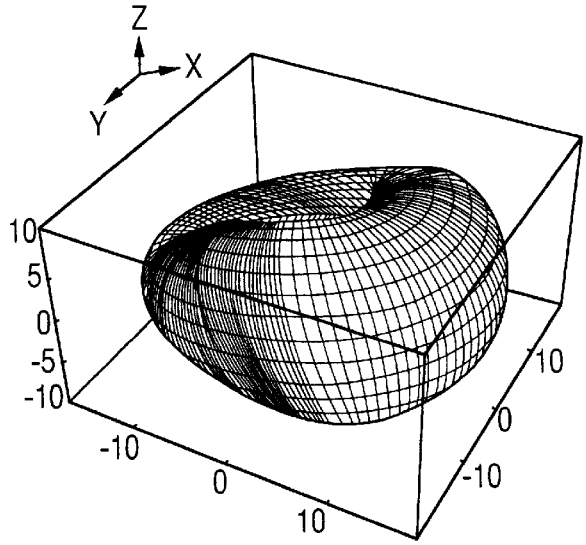
FIG. 7 is a top view of the envelope of a rotary piston engine with an oloid having no sphere in the center.

FIGS. 6 and 7 illustrate the interior layout of the housing if there is to be an oloid functioning as piston inside-the housing. Production of a housing such as this has already been described in conjunction with the shape and movement of the oloid.

Figure 10:
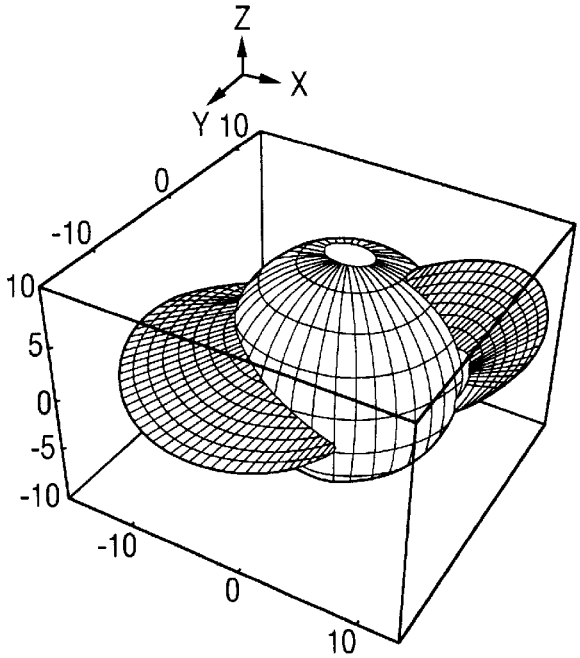
FIG. 10 is a diagrammatic view of an oloid rotary piston with a large sphere in its center in accordance with the present invention.

The rotary piston with large penetrating sphere shown in FIG. 10 illustrates clearly the ends 1 and 2 that engage in the dual-axis movement of the oloid.

Figure 11:
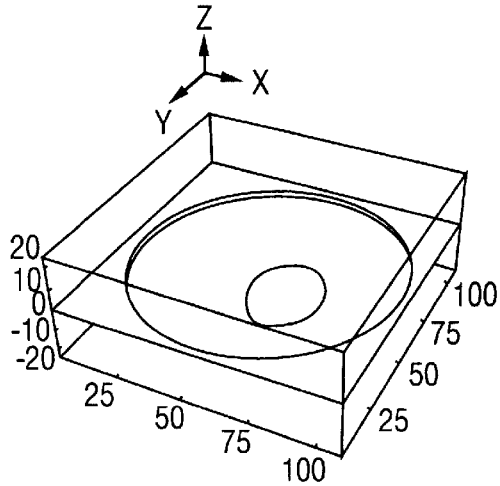
FIG. 11 is a diagrammatic view of the bottom enveloping surface of an oloid rotary piston engine having an oloid with a superimposed sphere in accordance with the present invention.
Figure 8:
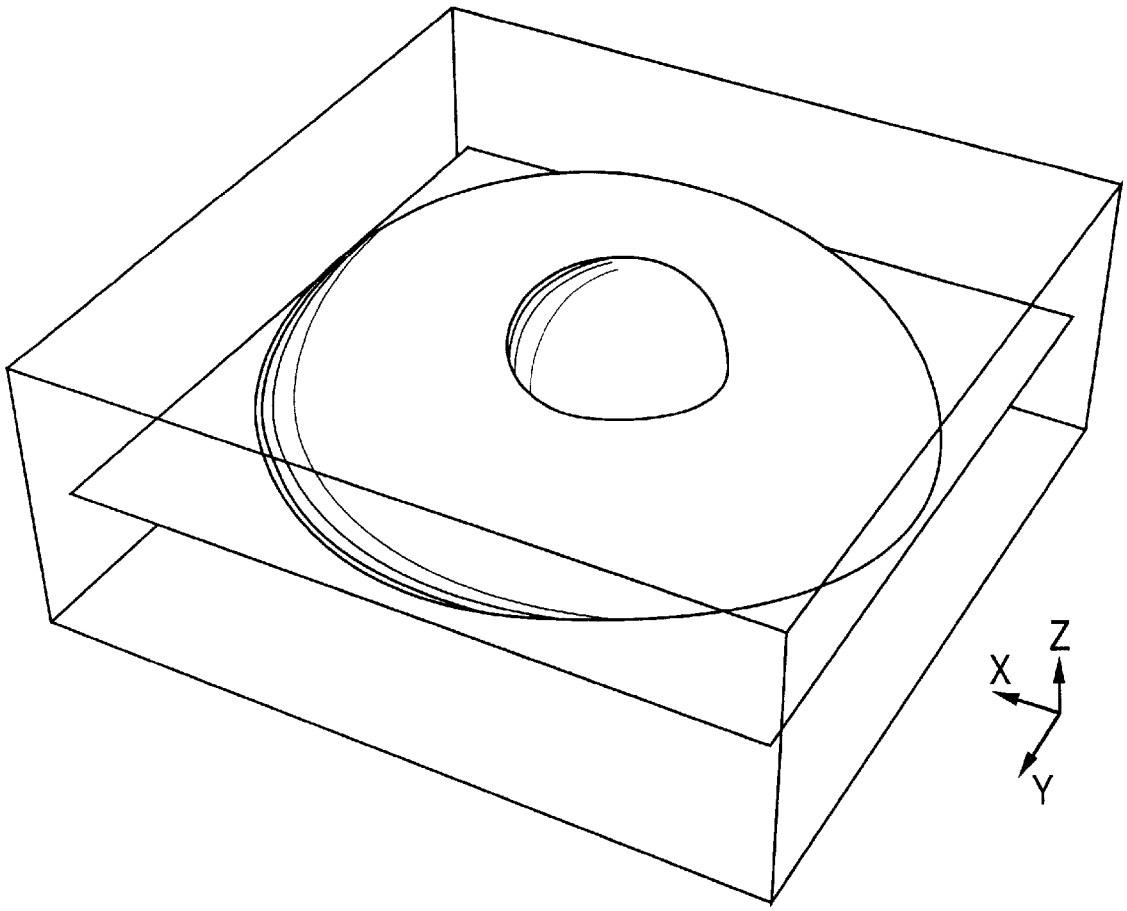
FIG. 8 is a further top view of the envelope of the claimed invention, including a superimposed sphere, encompassed by the top half shell of the housing.

FIG. 11 illustrates the top or bottom enveloping surface of the rotary piston engine according to the present invention, showing an internal sphere at the bottom. The layout may be used either for delivery (pumping) or energy production by introducing intake and outlet openings (opposite each other). The inlet and outlet openings may be designed so that slight overlapping of intake and outlet may be achieved. This layout requires no valves, because the motion of piston provides distinct sealed chambers 4, 5.

Figure 13:
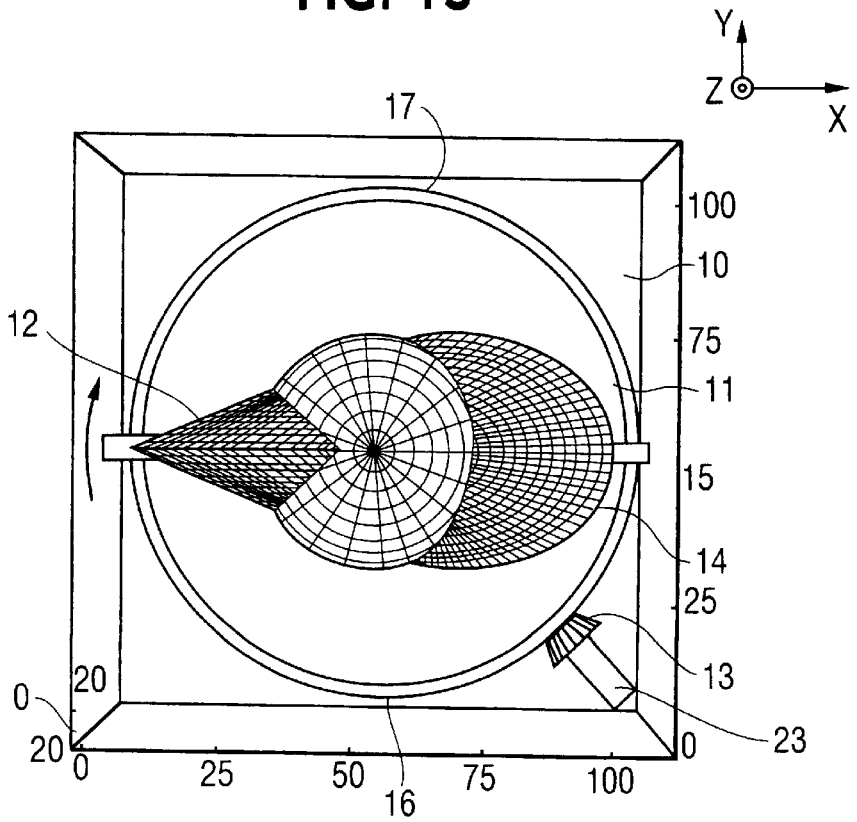
FIG. 13 is a top view of a rotary piston engine according to the invention with a journal-mounted oloid in a ring, the top half of the housing being removed.

In all instances of application of the invention as an engine there must be external coupling of the piston. This can be accomplished, for example, by means of the systems shown in FIG. 13. The piston 12 is mounted inside two housing halves 10 so as to be rotatable about both its horizontal and vertical axes.

Figure 14:
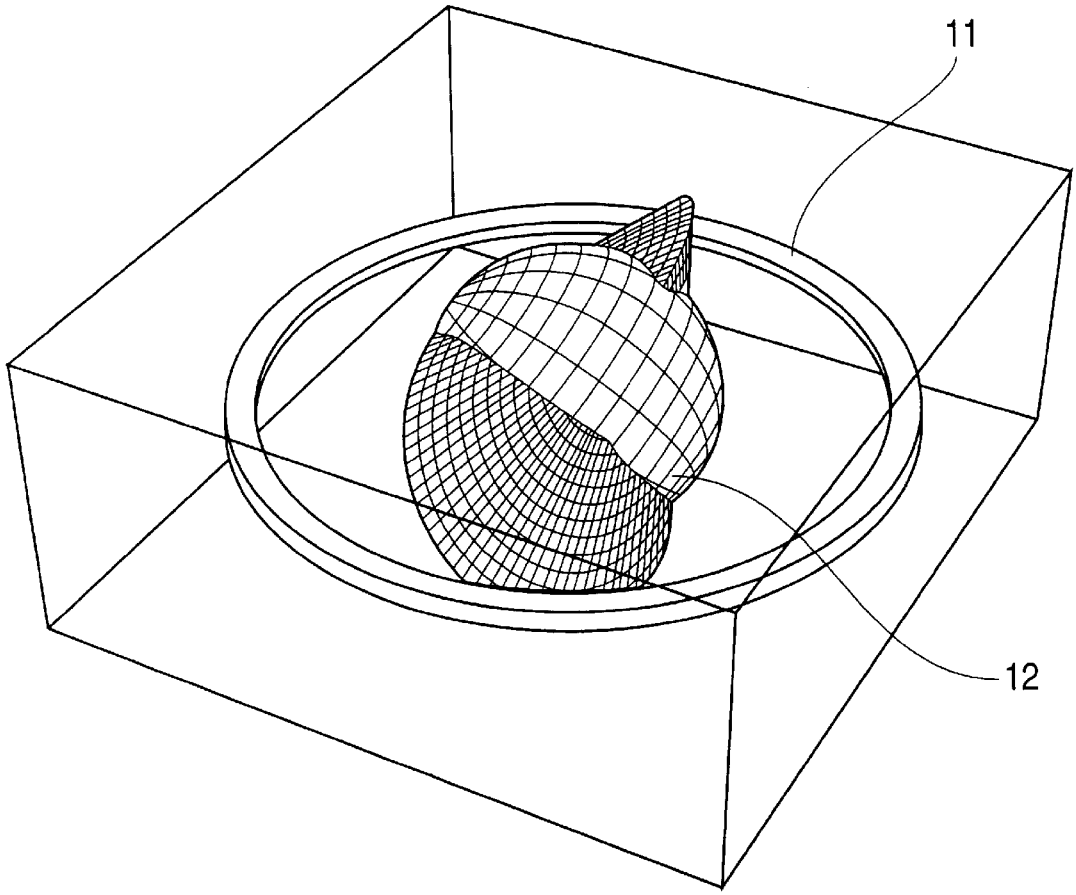
FIG. 14 shows a further top view of a rotary piston engine as claimed for the invention with a journal mounted oloid in a ring, the two shells of the housing being removed and the piston being in mid rotation.

A tread ring 11 rigidly connected to the horizontal axis of the rotary piston 12 is mounted in the plane of separation between top and bottom of the housing. The rotary piston 12 pivots about the horizontal axis in a journal mount 15 and can follow the envelope approximately described in FIG. 11 freely. The tread ring 11, shown also in FIG. 14, is provided with a bevel gear 13 which transfers the movement of the piston from the housing by way of a conical bevel wheel shaft 23 mounted in the housing. Reference numerals 16 and 17 designate an inlet and outlet for a medium employed for the purpose of actuating the piston 12 or the conical bevel wheel 13.

Figure 5:
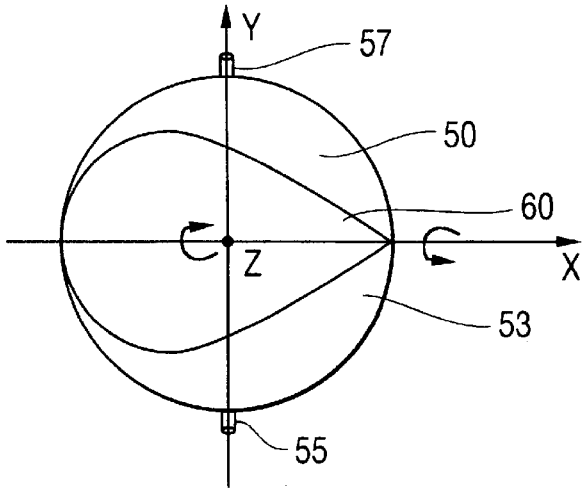
FIG. 5 is a top view of a vacuum pump system embodiment of the invention, the envelope or housing being shown only in schematic form.
Figure 9:
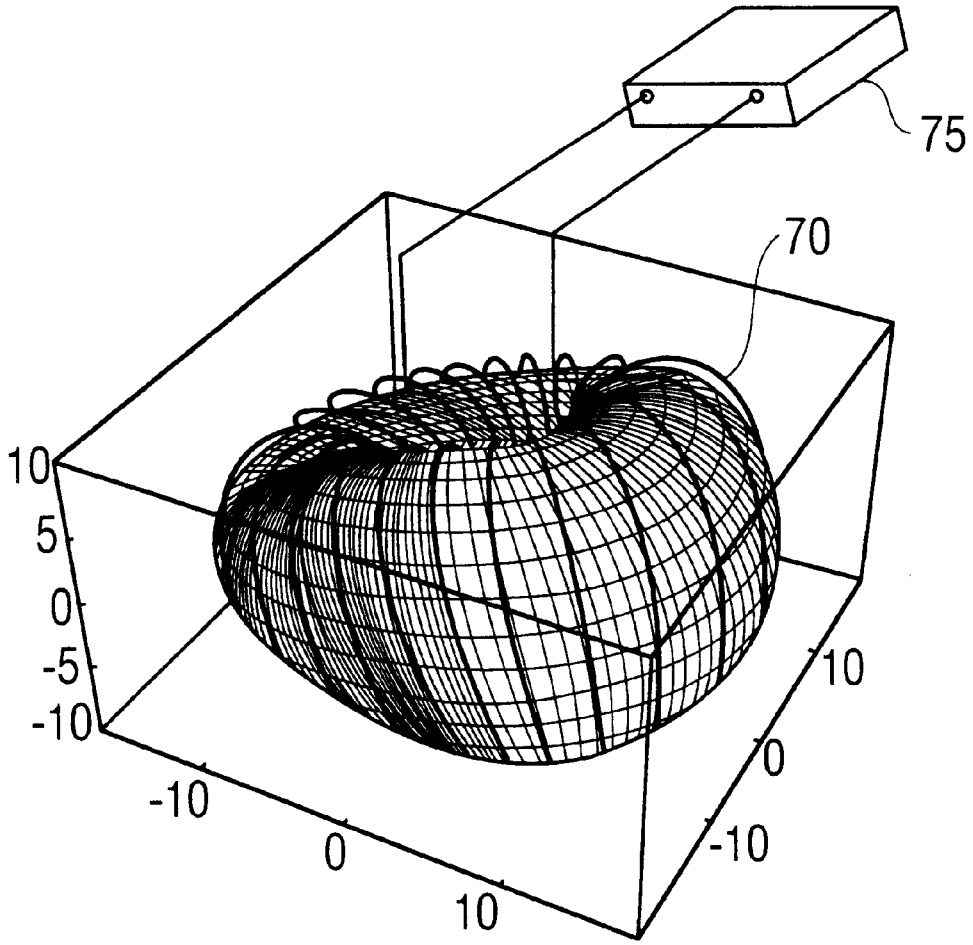
FIG. 9 is a schematic view of the vacuum pump and electric motor embodiment of the invention.
Figure 12:
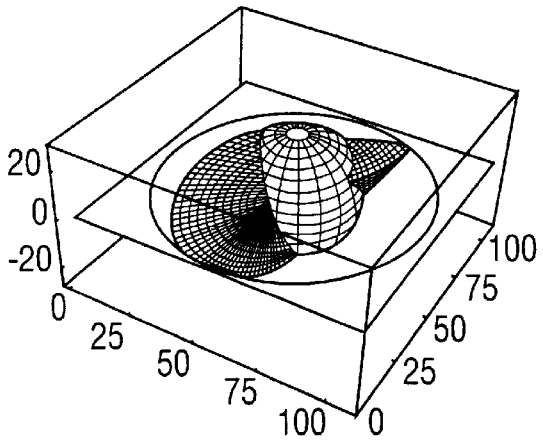
FIG. 12 shows the oloid rotary piston of FIG. 10 introduced into the bottom enveloping surface illustrated in FIG. 11.

A further embodiment is disclosed in FIGS. 5 and 9, providing the option of designing the rotary piston as the armature 60 of an electric motor and of providing the envelope with a suitable winding 70. An expansion chamber 50 and a compression chamber 55 are defined by the piston armature 60, as shown in FIG. 5. A commuter logic 75 is provided to control the armature. An intake 57 and an outlet 55 are located opposite one another perpendicular to the XZ plane, a plane of symmetry through the envelope.

Figure 15:
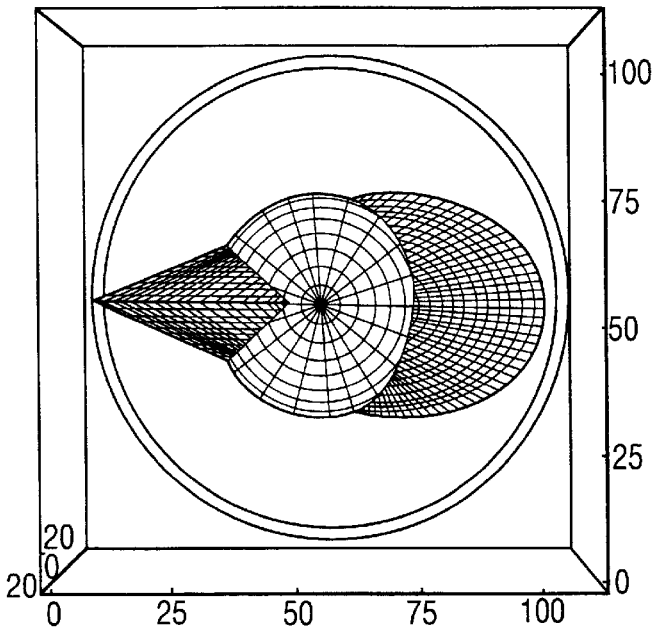
FIGS. 15–17 are top, side and front views, respectively, of an oloid rotary piston in accordance with the present invention for a rotary piston engine.
Figure 16:
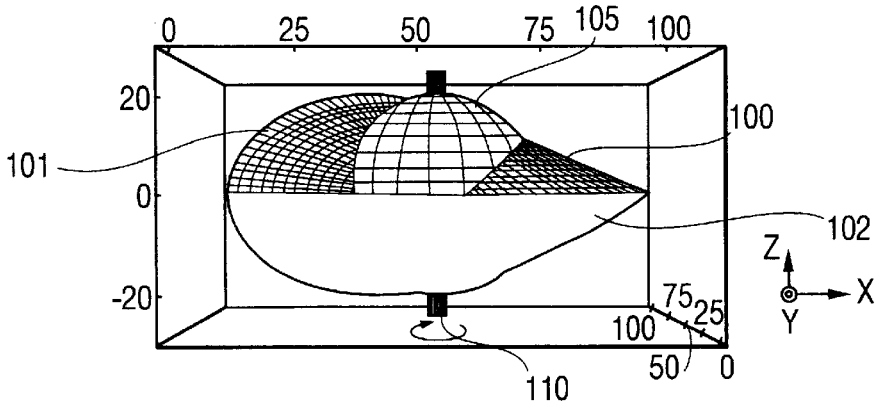
Figure 17:
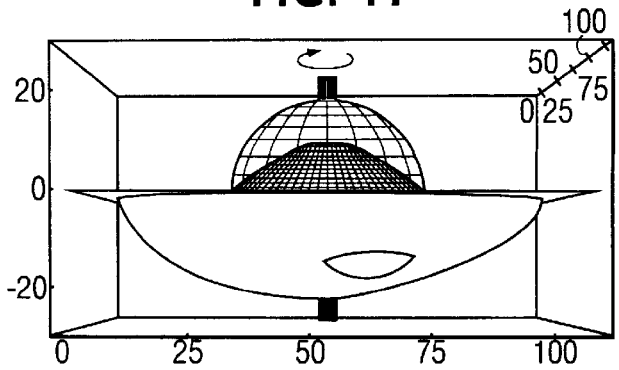

Additional embodiments of the invention are represented by multistage rotary piston engines. FIGS. 15–17 are top, side, and front views, respectively, of an embodiment of the invention, showing an oloid piston in a rotary piston engine. A mechanical coupling of forces is achieved by providing a piston designed to be in three parts, specifically, in such a way that the sphere 105 is released from the piston 100 as a separate component rotatably about the vertical axis as shown in FIG. 16. The piston 100 then consists of the sphere and two equal remaining parts 101,102. The sphere may then be provided with a shaft 110 extending vertically relative to the force coupling and with horizontal axis relative to a movable connection between the two piston 101,102 halves and the sphere 105.

Because of the special geometry, the compression ratio may be varied only over a narrow range. In order to achieve higher compression ratios or expansion by way of a larger area, it may be necessary to connect several pistons of different sizes in series. The design with a sphere in the center and a common drive shaft is suitable for this purpose. The intake and outlet openings may be mounted opposite each other in the envelopes so that short paths between the stages and highly compact engines can be achieved.

In a multivane rotary piston engine using the instant invention, the embodiment with a sphere in the center also makes it possible to mount two lateral vanes on the sphere (blower layout), the vanes following the envelope during rotation about the horizontal axes.

In the arrangement of the rotary piston engine of the present invention as an internal combustion engine, a layout such as that employed in gas turbines is suitable because of the relatively low compression ratio and the fact that the rotary piston engine simultaneously compresses and draws in (two cycles per revolution about the vertical axis). An intake and compression stage (or stages) fills a combustion chamber in which combustion takes place continuously. The expanding gas powers an expansion stage (or stages). Here as well, the individual stages may be mounted in line on a shaft, with intake and discharge opposite each other. The combustion chamber may be positioned between the compressor and expansion stages, as in conventional turbines.

Omission of a piston rod and a crankshaft makes the design simpler, significantly more compact, and lighter than conventional designs, and, since rotation takes place about the center of mass, quiet operation and good efficiency are to be expected with the rotary piston systems of the present invention.

In a generalized rotary piston system as claimed for the invention the piston consists essentially of two geometric plane elements or geometric bodies which are spaced at specific distances from each other and which have a common surface. Such elements may be ellipses or other shapes, but may just as well be cylinders or cuboids, which may be caused to rotate about one, two, or three axes. The interior of the housing formed by shells has more or less a shape derived from a sphere, one which results from rotation of the piston thus formed (about one, two, or more axes), at least one fluid intake and outlet being mounted essentially in the area of the equatorial plane, diametrically opposite each other, perpendicular to and distal from the plane of symmetry of the interior.

What is claimed is:

1. A rotary piston system comprising:

a housing comprising two half shells sealed to one another along a sealing plane, the housing having an interior defined by the two half shells;

a generally oloid shaped rotatable piston arranged for rotation within the interior of the housing; and a fluid intake extending into the housing and an outlet extending out of the housing, said intake and said outlet being positioned generally in the area of said sealing plane, said intake and said outlet being further positioned opposite each other and perpendicular to and distal from a plane of symmetry dividing the interior of the housing into two portions which are symmetrical with respect to one another.

2. The rotary piston system of claim 1, wherein the generally oloid shaped rotatable piston further comprises an oloid shaped volume formed by the intersection of a first circle oriented in a first plane and a second circle oriented in a second plane perpendicular to said first plane, a point along the circumference of the second circle intersecting the center of said first circle; and an additional geometric volume generally enclosing the region of intersection between said first and second circles.

3. The rotary piston system of claim 2, wherein said additional geometric volume is spherical.

4. The rotary piston system of claim 1, wherein said interior defines a first chamber and a second chamber, said first and second chambers being separated and sealed apart from one another by said piston.

5. The rotary piston system of claim 1, wherein the volume of said interior is defined by rotation of said generally oloid shaped rotatable piston along at least two axes of rotation.

6. The rotary piston system of claim 1, wherein the volume of said interior has a maximum diameter generally equal to the longitudinal extent of the generally oloid shaped rotatable piston.

7. The rotary piston system of claim 1, further comprising electromagnetic windings extending around the interior, wherein the generally oloid shaped rotatable piston is an armature, and the system is an electric motor.

8. The rotary piston system of claim 1, further comprising electromagnetic windings extending around the interior, wherein the generally oloid shaped rotatable piston is an armature, and the system is a pump.

9. The rotary piston system of claim 1, wherein the generally oloid shaped piston further comprises an oloid shaped volume generally formed by the intersection of a first circular shape oriented in a first plane and a second circular shape oriented in a second plane perpendicular to said first plane, a point along the perimeter of the second circular shape intersecting the center of said first circular shape;

an additional geometric volume enclosing the region of intersection between said first and second circular shapes, and a journal element rotatably positioned in each of the half shells along a common axis, said journal elements connecting to said additional geometric volume in polar areas of the geometric volume.

10. The rotary piston system of claim 9, wherein the rotary piston system is an engine.

11. The rotary piston system of claim 9, wherein the rotary piston system is a internal combustion engine.

12. The rotary piston system of claim 1, further comprising, a ring positioned in a recess between the two half shells, said ring being rotatable in said sealing plane, the rotatable piston being positioned within said ring and connected to said ring for rotation of said ring.

13. The rotary piston system of claim 12, wherein the rotary piston system is an engine.

14. The rotary piston system of claim 12, wherein the rotary piston system is a pump.

15. The rotary piston system of claim 12, wherein the rotary piston system is a generator.

* * * * *